US005447134A

United States Patent [19]

Yokoyama

[11] Patent Number: 5,447,134

[45] Date of Patent: Sep. 5, 1995

[54] THROTTLE VALVE CONTROL SYSTEM FOR ENGINE

[75] Inventor: Etsuya Yokoyama, Hyogo, Japan

[73] Assignee: Mitsubishi Denki Kabushiki Kaisha, Tokyo, Japan

[21] Appl. No.: 118,237

[22] Filed: Sep. 9, 1993

[30] Foreign Application Priority Data

Sep. 9, 1992 [JP] Japan ..... 4-240413

[51] Int. Cl.[6] ..... F02D 9/00

[52] U.S. Cl. ..... 123/399; 73/118.1; 74/513

[58] Field of Search ..... 123/396, 399; 73/118.1; 74/514, 513

[56] References Cited

U.S. PATENT DOCUMENTS 4,768,483 9/1988 Asayama ..... 123/399

5,216,916 6/1993 Bederna et al. ..... 73/118.1

FOREIGN PATENT DOCUMENTS 60-4838 1/1985 Japan .

*Primary Examiner*—Noah P. Kamen

*Attorney, Agent, or Firm*—Sughrue, Mion, Zinn, Macpeak & Seas; Richard C. Turner; Marie-Claire Boisvert

[57] ABSTRACT

In a throttle valve control system, an accelerator pedal position sensor (APS) comprises a first APS for detecting a large amount of movement of an accelerator pedal which is relatively low in resolution and a second APS for detecting middle and small amounts of movement of the accelerator pedal which is relatively high in resolution, and a throttle valve controlling ECU has abnormal condition detector which determines that at lease one of the first and second APSs is in abnormal condition when the relationship between the output voltages of the first and second sensors is different from that which is established when the first and second APSs are in normal condition. Therefore, even when the accelerator pedal is moved slightly which has been positioned to open the throttle valve to a low or middle degree, the throttle valve is controlled, which improves the operability of the engine. The abnormal condition detector detects when at least one of the first and second APSs is out of order, so that the difficulty is eliminated that it becomes impossible to control the throttle valve when the accelerator pedal position sensor is out of order; that is, the vehicle is improved in safety.

8 Claims, 4 Drawing Sheets

THROTTLE VALVE CONTROL SYSTEM FOR ENGINE

BACKGROUND OF THE INVENTION

This invention relates to a throttle valve control system for an engine which detects the amount of movement of the accelerator pedal with an accelerator position sensor to electronically control the throttle valve.

In a conventional throttle valve control system, for instance, in a motor vehicle, the accelerator pedal is coupled through a mechanical link to the throttle valve as shown in FIG. 5.

FIG. 5 outlines the arrangement of the conventional throttle valve control system which is adapted to mechanically drive the throttle valve. In FIG. 5, reference numeral 1 designates an air intake passageway of an engine (not shown); 2, a throttle valve arranged in the air intake passageway 1; and 3, an accelerator pedal which is operated to manually open and close the throttle valve 2. The accelerator pedal is coupled to the throttle valve 2 through an intermediate link 6 consisting of an accelerator wire 4 and a pulley 5.

The intermediate link 6 is so designed that the degree of opening of the throttle valve changes non-linearly with the amount of action of the accelerator pedal 3 as shown in FIG. 6. FIG. 6 is a graphical representation indicating the relationship between the degree of opening of the throttle valve and the amount of action of the accelerator pedal.

The reason why the degree of opening of the throttle valve is changed non-linearly (in a sense of a quadratic curve) is that, when the accelerator pedal is positioned in a range from the position where it is not actuated to the position where it is halfway actuated (hereinafter referred to as "a low action range", when applicable), the accelerator pedal can be delicately operated to finely adjust the engine output and the vehicle speed. This feature is effective in the case where a motor vehicle is traveling on a congested road or in town; that is, in the case where it is necessary for the vehicle to move at a very low speed or to start and stop repeatedly. The delicate action of the accelerator pedal together with suitable braking operation makes it possible to adjust the vehicle speed with ease. On the other hand, when the accelerator pedal is positioned in a range of full action, an increment in the degree of opening of the throttle valve is larger than that in the amount of action of the accelerator. This is because when the engine should be accelerated greatly as in the case where the vehicle goes onto a highway, generally it is unnecessary to delicately control the engine output.

In the conventional throttle valve control system, as was described above, the intermediate link 4 is mechanically designed with the wire 4 and the pulley 5 so that the degree-of-opening characteristic of the throttle valve 2 is non-linear as shown in FIG. 6. Therefore, the throttle valve control system is limited in the degree of freedom in determining the degree-of-opening characteristic. For instance, it is difficult to obtain a degree-of-opening characteristic as indicated by the broken line in FIG. 6. Even if it is obtained, another problem is raised because it cannot be obtained without making the intermediate link 4 an intricate part of the structure. Furthermore, if the intermediate link 4 is determined to provide a certain degree-of-opening characteristic, then it is difficult to adjust the characteristic in conformance with the vehicle characteristic (such as the engine performance). In addition, the use of the wire 4 creates a problem in that hysteresis or operating delay occurs.

In order to eliminate the above-described difficulties, the use of the intermediate link has recently been suspended. A conventional throttle valve control system of this type is as shown in FIG. 7.

FIG. 7 is a block diagram outlining the arrangement of the conventional throttle valve control system. The device comprises an accelerator pedal position sensor 7 (hereinafter referred to merely as "an APS 7", when applicable) for detecting the amount of action of an accelerator pedal (not shown); a throttle valve actuator 8 coupled to a throttle valve (not shown); a throttle valve position sensor 9 (hereinafter referred to merely as "a TPS 9", when applicable); and a throttle valve controlling electric control unit 10 (hereinafter referred to as "a throttle valve controlling ECU 10", when applicable) for controlling the throttle valve actuator 8.

The APS 7 is so designed as to output a voltage in proportion to the amount of action of the accelerator pedal, and its output characteristic is as shown in FIG. 8.

The operation of the throttle valve controlling ECU 10 will now be described. The throttle valve controlling ECU 10 obtains an aimed degree-of-opening of the throttle valve referring to the amount of action of the accelerator pedal detected by the APS 7 and the throttle valve degree-of-opening map (the characteristic indicated by the broken line) as shown in FIG. 6, and performs feedback control so that the actual degree-of-opening of the throttle valve becomes the aforementioned aimed degree-of-opening of the throttle valve.

With the conventional throttle valve control system constructed as described above, the throttle valve degree-of-opening characteristic can be freely set by changing the throttle valve degree-of-opening map, and it can be adjusted according to the vehicle performance.

However, even if the throttle valve is electronically controlled to make the throttle valve degree-of-opening characteristic non-linear as was described above, the engine is not always high in operability when the accelerator pedal is positioned in the above-described low action range. This is due to the fact that detecting resolution of the APS 7 for detecting the degree-of-opening of the throttle valve is low.

In order to delicately operate the accelerator pedal to finely adjust the engine output and the vehicle speed, it is desirable that, even if the amount of movement of the accelerator pedal is small, the throttle valve is opened or closed with high responsibility. However, since the conventional APS 7 is low in detecting resolution during the low action range, the accelerator pedal must be operated greatly to some extent.

This problem can be solved by employing an APS which is high in detecting resolution. However, employing an APS which is high in detecting resolution raises another problem. That is, in the case where the accelerator pedal is positioned in the range of full action, it is unnecessary to have a high detecting resolution, and therefore half of the detecting region of the APS 7 is useless.

Furthermore, with the system, the degree-of-opening of the throttle valve is determined according to the amount of action of the accelerator pedal detected by the APS 7. Hence, if the APS 7 is out of order, the system cannot control the throttle valve any longer, so that the degree-of-opening of the throttle valve is fixed, and at worst the throttle valve may be fixed fully opened. Thus, the conventional device is not reliable in safety.

SUMMARY OF THE INVENTION

Accordingly, an object of this invention is to eliminate the above-described difficulties accompanying a conventional throttle valve control system. More specifically, an object of the invention is to provide a throttle valve control system for an engine which enhances the operability of the engine even when the accelerator pedal is positioned in the low action range, and which improves the safety of the vehicle by eliminating the difficulty that it cannot control the throttle valve when the accelerator pedal position sensor is faulty.

The foregoing object of the invention has been achieved by the provision of a throttle valve control system for an engine in which an accelerator pedal position sensor comprises a first sensor relatively low in detecting resolution and a second sensor relatively high in detecting resolution, and a control unit which operates to detect the amount of movement of the accelerator pedal with the second sensor when the amount of movement is smaller than a predetermined value, and with the first sensor when larger. The control unit, including abnormal condition detecting means, determines that the first sensor and/or the second sensor is in an abnormal condition when the relationship between the output voltages of the first and second sensors is different from that which is established when the first and second sensors are in normal condition.

When the amount of movement of the accelerator pedal is smaller than the predetermined value, it is detected by the second sensor which is relatively high in resolution. Therefore, even when the accelerator pedal is moved slightly, the throttle valve is controlled. If the first sensor and/or the second sensor is faulty, then its output voltage becomes different from that which is provided when it is in normal condition. This abnormal output voltage is detected by the abnormal condition detecting means.

DETAILED DESCRIPTION OF PREFERRED EMBODIMENT

One preferred embodiment of this invention will be described with reference to FIGS. 1 through 4.

Figure 1:
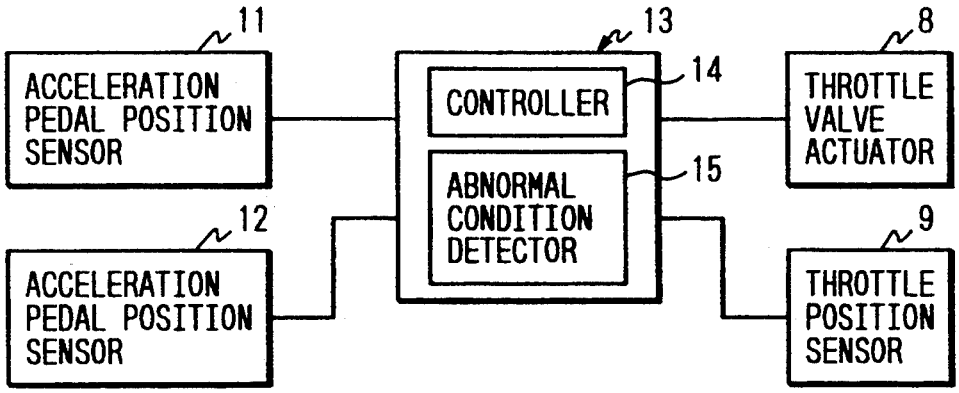
FIG. 1 is a block diagram outlining the arrangement of a throttle valve control system for an engine according to this invention.
Figure 2:
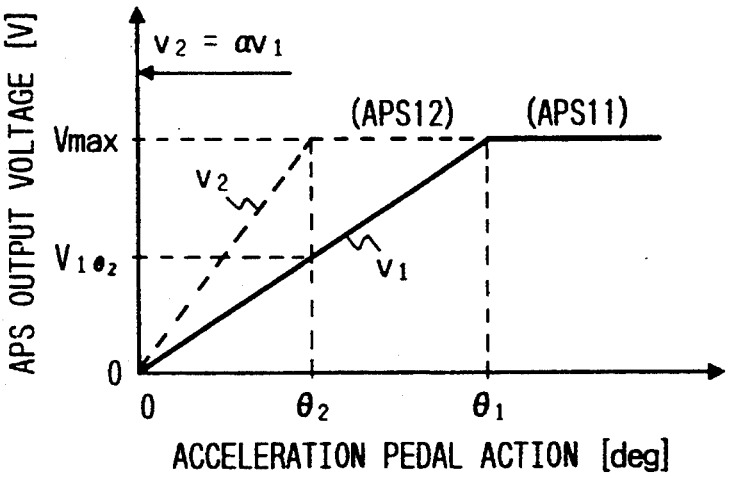
FIG. 2 is a graphical representation showing the output characteristics of first and second sensors.
Figure 3:
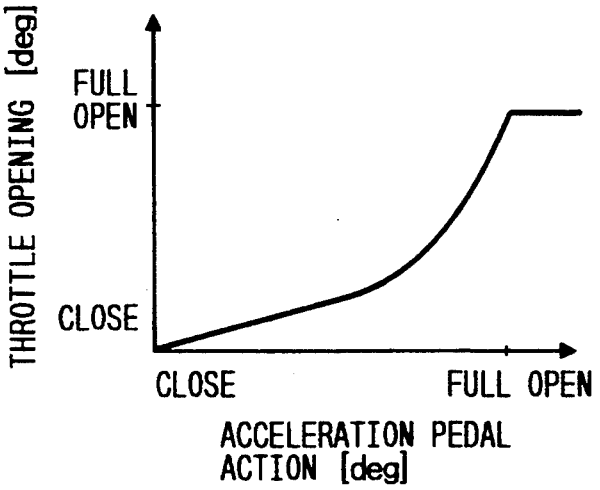
FIG. 3 is a graphical representation corresponding to a throttle valve degree-of-opening map provided for a throttle valve controlling ECU.
Figure 4:
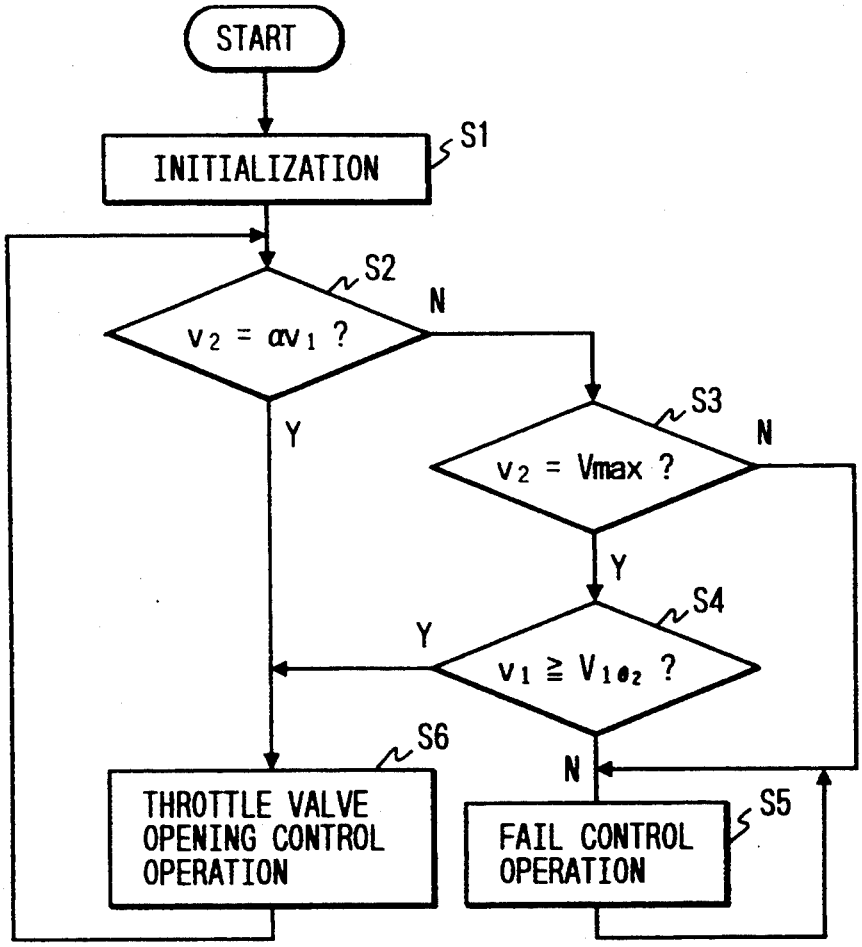
FIG. 4 is a flow chart for a description of the operation of the throttle valve controlling ECU.
Figure 5:
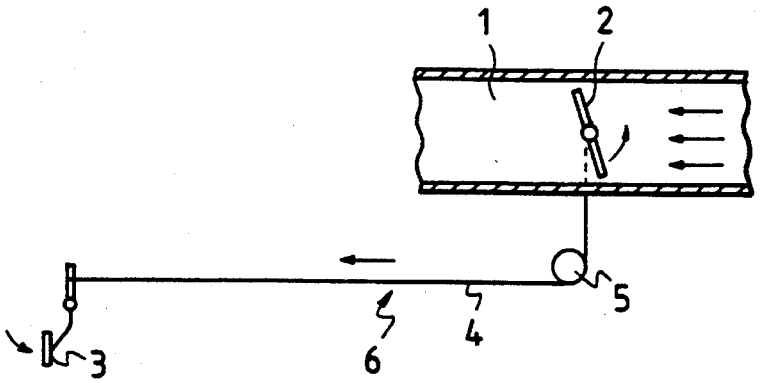
FIG. 5 PRIOR ART
FIG. 5 is an explanatory diagram outlining the arrangement of a conventional throttle valve control system which is adapted to mechanically drive a throttle valve.
Figure 6:
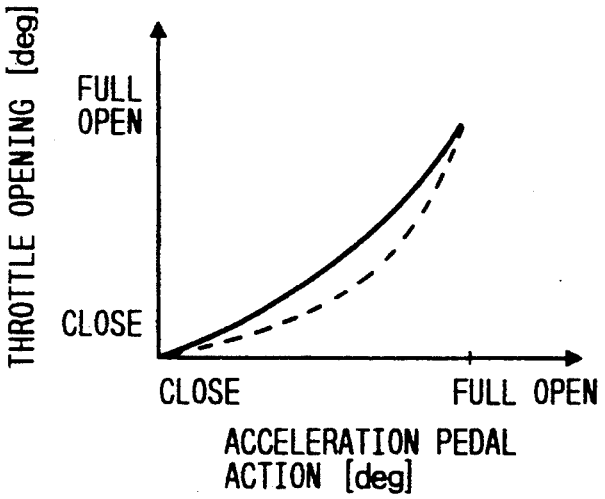
FIG. 6 PRIOR ART
FIG. 6 is a graphical representation indicating the relationships between the amount of movement of an accelerator pedal and the degree of opening of a throttle valve in a link type throttle valve control system.
Figure 7:
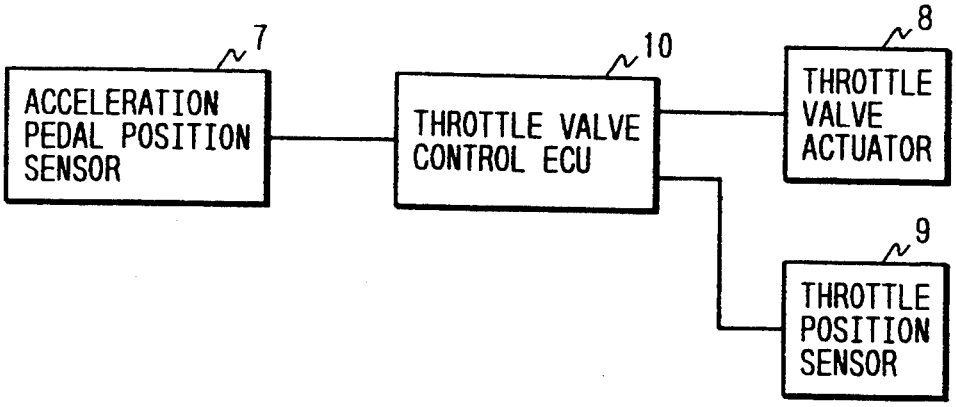
FIG. 7 PRIOR ART
FIG. 7 is a block diagram outlining the arrangement of a conventional throttle valve control system which electronically controls a throttle valve.
Figure 8:
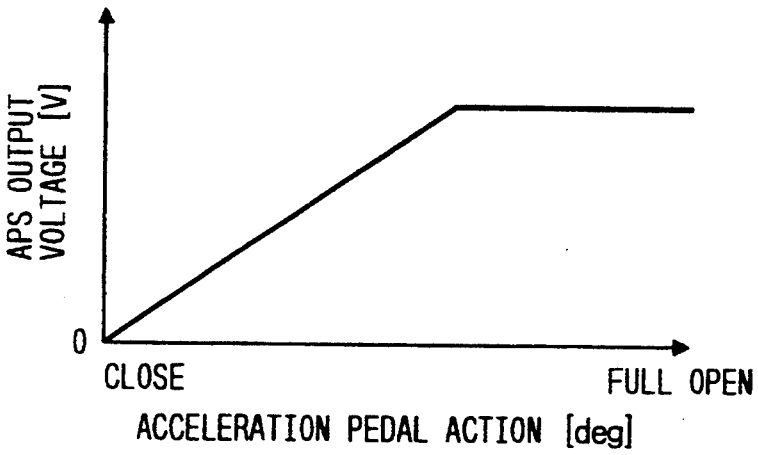
FIG. 8 PRIOR ART
FIG. 8 is a graphical representation showing the output characteristic of an accelerator pedal position sensor in the conventional throttle valve control system.

FIG. 1 is a block diagram outlining the arrangement of a throttle valve control system for an engine according to the invention. FIG. 2 is a graphical representation showing the output characteristics of the first and second sensors. FIG. 3 is a graphical representation corresponding to a throttle valve degree-of-opening map provided for a throttle valve controlling ECU. FIG. 4 is a flow chart for a description of the operation of the throttle valve controlling ECU. In FIGS. 1–4, parts corresponding functionally to those which have been described with reference to FIG. 7 are designated by the same reference numerals or characters.

In FIG. 1, reference numeral 11 designates a first sensor which is an APS; and 12, a second sensor which is an APS. The APS 12 is higher in detecting resolution than the APS 11. Similarly, as in the case of the conventional throttle valve control system, the APS 11 and the APS 12 are connected to an accelerator pedal, and apply voltages corresponding to the amount of action of the accelerator pedal to a throttle valve controlling ECU 13 (described later).

The output characteristics of the APS 11 and the APS 12 are as indicated in FIG. 2. More specifically, in FIG. 2, the solid line represents the output characteristic of the APS 11, and the broken line represents the output characteristic of the APS 12. The output characteristics of the APS 11 and the APS 12 are such that they are equal in maximum output voltage ($V_{max}$) and different in the amount of action of the accelerator petal at which the maximum output voltage is obtained. The APS 11 is so designed that its output voltage $V_{max}$ is maximum when the accelerator pedal is fully actuated; that is, when the amount of action is $\Theta_1$; whereas the APS 12 is so designed that its output voltage $V_2$ is maximum when the amount of action of the accelerator pedal is $\Theta_2$ which is approximately half of $\Theta_1$. In addition, in each of the APS's 11 and 12, after the output voltage has reached the maximum value, the output voltage is maintained unchanged even when the amount of action of the accelerator pedal is further increased.

The throttle valve controlling ECU 13 is a control unit in the throttle valve control system of the invention. The ECU 13 comprises control means 14 for controlling the throttle valve actuator 8 according to the amount of action of the accelerator pedal detected by the APS 11 and the APS 12; and abnormal condition detecting means for detecting abnormal conditions of the sensors from the output voltages $V_1$ and $V_2$ of the APS's 11 and 12.

The control means 14 has the degree-of-opening map of the throttle valve as shown in FIG. 3. The control means 14 obtains an aimed degree-of-opening of the throttle valve referring to the amount of action of the accelerator pedal detected by the APS 11 and the APS 12, and the throttle valve degree-of-opening map as shown in FIG. 3, and performs feedback control so that the actual degree-of-opening of the throttle valve becomes the aimed degree-of-opening of the throttle valve, thereby to drive the throttle valve actuator 8. In this connection, it should be noted that, when the amount of action of the accelerator pedal is smaller than a predetermined value; i.e., $\Theta_2$ at which the output voltage of the APS 12 is maximum, the amount of action of the accelerator pedal is detected by using the output of the APS 12; whereas when the amount of action of the accelerator pedal is larger than $\Theta_2$, the amount of action of the accelerator pedal is detected by using the output of the APS 11.

When the accelerator pedal is positioned in the low action range, the amount of action of the accelerator pedal is detected with the APS 12 which is relatively high in resolution. Hence, even when the accelerator pedal is operated slightly, the throttle valve is operated with high responsibility. This will be concretely described. It is assumed that, in FIG. 2, $\Theta_1$ is 90°, and $\Theta_2$ is 45°, and $V_{max}$ is 5 volts. The amount of change in the amount of movement of the accelerator pedal which changes the output voltage of the APS 12 by one volt is half of that which changes the output voltage of the APS 11 by the same volt, as is apparent from the following expressions (1) and (2):

$$\text{APS 11} \rightarrow 90\ (\text{deg})/5\ (\text{v}) = 18\ (\text{deg/V}) \quad (1)$$

$$\text{APS 12} \rightarrow 45\ (\text{deg})/5\ (\text{v}) = 9\ (\text{deg/V}) \quad (2)$$

That is, when the amount of movement of the accelerator pedal is in the low action range, the accelerator pedal can be delicately operated to finely adjust the engine output and the vehicle speed with ease.

The abnormal condition detecting means 15 will now be described. When the relationship between the output voltage of the APS 11 and the output voltage of the APS 12 is different from that which is established when the APS 11 and the APS 12 are in normal condition, it is determined that the APS 11 and/or APS 12 is in an abnormal condition. The abnormal condition detecting means 15 then operates to fully close the throttle valve; that is, performs a fail control operation. This will be described in more detail. In the case where, as shown in FIG. 2, the amount of action of the accelerator pedal is $\Theta_2$ or smaller under the normal condition, the output voltage $V_2$ of the APS 12 is $\alpha$ times the output voltage $V_1$ of the APS 11; and in the case where it is larger than $\Theta_2$, $V_2 = V_{max}$ and $V_1 \geqq V_{1\Theta 2}$ ($V_{1\Theta 2}$ is output voltage of APS 11 at the acceleration pedal action being at $\Theta_2$). If it is assumed that $V_2 = \alpha V_1$ is referred to condition 1, and $V_2 = V_{max}$ and $V_1 \geqq V_{1\Theta 2}$ to condition 2, then when not both conditions 1 and 2 are established, it is determined that the APS 11 and/or APS 12 is out of order.

The operation of the throttle valve controlling ECU 13 will be described in detail with reference to a flow chart of FIG. 4. When a main switch (not shown) is turned on, an initialization operation is carried out in Step S1. In Step S2, it is determined from the output voltages of the Aps 11 and the APS 12 whether or not condition 1, $v_2 = \alpha v_1$, is satisfied.

When in Step S2, $V_2$ is not equal to $\alpha V_1$, then Steps S3 and S4 are effected; that is, it is determined whether or not condition 2, $V_2 = V_{1max}$ and $V_1 \geqq V_{1\Theta 2}$, is satisfied. In the case when condition 2 is not satisfied; i.e., when neither condition 1 nor 2 is satisfied, and the relationship between the output voltages of the APS's 11 and 12 is abnormal, it is determined that the APS 11 and/or the APS 12 is in an abnormal condition, and in Step S5 the fail control operation is carried out—for instance, the throttle valve is fully closed.

When condition 1 is satisfied in Step S2 or when condition 2 is satisfied in Steps S3 and S4, then in Step S6 a throttle valve degree-of-opening control operation is carried out.

As was described above, in the throttle valve control system according to the invention, the accelerator pedal position sensor comprises the first sensor which is relatively low in detecting resolution and the second sensor which is relatively high in detecting resolution, and the control unit operates to detect the amount of movement of the accelerator pedal with the second sensor when it is smaller than the predetermined value, and with the first sensor when larger than the predetermined value. The control unit, including the abnormal condition detecting means, determines that the first sensor and/or the second sensor is in an abnormal condition when the relationship between the output voltages of the first and second sensors is different from that which is established when said first and second sensors are in normal condition.

Hence, when the amount of movement of the accelerator pedal is smaller than the predetermined value, it is detected by the second sensor which is relatively high in resolution. Therefore, even when the accelerator pedal is moved slightly, the throttle valve is controlled. If the first sensor and/or the second sensor is faulty, then its output voltage becomes different from that which is provided when it is in normal condition. This abnormal output voltage is detected by the abnormal condition detecting means.

Hence, the operability of the engine is improved even when the amount of movement of the accelerator pedal is in the low action range, and the difficulty is eliminated that it becomes impossible to control the throttle valve when the accelerator pedal position sensor is out of order; that is, the vehicle is improved in safety.

What is claimed is:

1. A throttle valve control system for an engine comprising:

actuator means for driving a throttle valve of said engine;

accelerator pedal position sensor means, connected to an accelerator pedal, for detecting movement of said accelerator pedal, said accelerator pedal position sensor means comprising a first sensor relatively low in resolution and a second sensor relatively high in resolution; and control means for controlling said actuator means according to the amount of movement of said accelerator pedal which is detected by said accelerator pedal position sensor means.

2. A throttle valve control system as claimed in claim 1, wherein said control means controls said actuator means in accordance with an output signal from said second sensor when said amount of movement of said accelerator pedal is smaller than a predetermined value, and wherein said control means controls said actuator means in accordance with an output signal from said first sensor when said amount of movement of said accelerator pedal is larger than said predetermined value.

3. A throttle valve control system as claimed in claim 2, wherein said control means comprises abnormal condition detecting means which determines when at least one of said first sensor and said second sensor is in an abnormal condition when the relationship between said output voltage of said first sensor and said output voltage of said second sensor is different from that which is established when said first sensor and said second sensor are operating in normal condition.

4. A throttle valve control system as claimed in claim 1, wherein said control means comprises abnormal condition detecting means which determines when at least one of said first sensor and said second sensor is in an abnormal condition when the relationship between an output voltage of said first sensor and an output voltage of said second sensor is different from that which is established when said first sensor and said second sensor are operating in normal condition.

5. A throttle valve control system for an engine comprising:

an actuator which drives a throttle valve of said engine;

an accelerator pedal position sensor, connected to an accelerator pedal, which detects movement of said accelerator pedal, said accelerator pedal position sensor comprising a first sensor relatively low in resolution and a second sensor relatively high in resolution; and a control unit which controls said actuator according to the amount of movement of said accelerator pedal which is detected by said accelerator pedal position sensor.

6. A throttle valve control system as claimed in claim 5, wherein said control unit controls said actuator in accordance with an output signal from said second sensor when said amount of movement of said accelerator pedal is smaller than a predetermined value, and wherein said control unit controls said actuator in accordance with an output signal from said first sensor when said amount of movement of said accelerator pedal is larger than said predetermined value.

7. A throttle valve control system as claimed in claim 6, wherein said control unit comprises abnormal condition detecting means which determines when at least one of said first sensor and said second sensor is in an abnormal condition when the relationship between said output voltage of said first sensor and said output voltage of said second sensor is different from that which is established when said first sensor and said second sensor are operating in normal condition.

8. A throttle valve control system as claimed in claim 5, wherein said control unit comprises abnormal condition detecting means which determines when at least one of said first sensor and said second sensor is in an abnormal condition when the relationship between an output voltage of said first sensor and an output voltage of said second sensor is different from that which is established when said first sensor and said second sensor are operating in normal condition.

* * * * *